United States Patent [19]

Colmenero

[11] 4,365,245

[45] Dec. 21, 1982

[54] DISPLAY MODULE FOR TRAVELING PATTERN SIGNS

[76] Inventor: Gustavo T. Colmenero, 2624 Walnut La., Plano, Tex. 75075

[21] Appl. No.: 912,211

[22] Filed: Jun. 5, 1978

[51] Int. Cl.[3] ..... G09G 3/00

[52] U.S. Cl. ..... 340/792; 340/800; 340/791

[58] Field of Search ..... 340/789, 792, 800, 801, 340/793, 803, 791

[56] References Cited

U.S. PATENT DOCUMENTS 3,432,846 3/1969 Jones et al. ..... 340/803

3,651,511 3/1972 Andrews et al. ..... 340/793

*Primary Examiner*—Marshall M. Curtis

*Attorney, Agent, or Firm*—Hubbard, Thurman, Turner & Tucker

[57] ABSTRACT

A display module which controls a sequence of lights, for interconnection with other modules of the same kind to form a display system. The module controls the intensity of each light in its sequence so as to display a time varying brightness pattern that moves at a selected rate along the sequence. The light pattern may be selected from multiple patterns generated by the module. The display module includes a parallel output for driving other modules so as to synchronously display the same pattern. There is also a serial output, whereby the light pattern, after moving through the sequence of lights associated with the display module, moves through a sequence of lights associated with another module.

6 Claims, 2 Drawing Figures

DISPLAY MODULE FOR TRAVELING PATTERN SIGNS

BACKGROUND OF THE INVENTION

This invention relates to lighted signs and displays, and, in particular, to a display module which controls a sequence of lights, for interconnection with modules of the same kind to form a display system.

Some of the most effective signs and displays are light displays using patterns of changing brightness. These include complex marquee and casino signs in which patterns appear to move through sets of lights formed in elaborate shapes. In recent years, large computer-driven light arrays have been used to form stadium scoreboards of great versatility. All of these elaborate displays are, of course, expensive. They ordinarily represent a highly specialized, carefully planned installation. A computer-driven array can be standardized, reducing cost, but the user is limited to using a light array of a standard shape.

A much simpler display is the use of a changing brightness pattern in lights that form a border of a sign. This is ordinarily accomplished with a rotating motor that sequentially activates switches controlling the lights in the border. Such a display can be made relatively inexpensive; on the other hand, it is quite limited.

The present invention concerns a simple, inexpensive, but versatile light control module which can be utilized as simply as a Christmas tree light controller or can be interconnected with as many other such modules as desired to form complex light displays.

SUMMARY OF THE INVENTION

In accordance with the present invention, there is provided a display module with an associated set of lights. The module includes switching means for controlling each light in the set. A pattern generator causes the switching means to produce a time-varying brightness pattern in the set of lights. In addition, there is provided an input for driving the controlling means from an external source, including from another module of the same kind. A parallel output allows the display module to drive a module of the same kind to synchronously display the same light pattern. A serial output permits the display module to drive another module of the same kind so that a brightness pattern moving through the set of lights in sequence then proceeds on in sequence through a set of lights in sequence through a set of lights associated with the other module. Using these outputs and inputs, a group of such modules can be interconnected to form a light display.

In a preferred embodiment of the invention, the display module includes means for generating a variety of patterns to be displayed in the lights associated therewith. Also in a preferred embodiment, a pattern moves through the set of lights in sequence, at a speed which is selectable. In another embodiment of the invention, the brightness of all the lights in the set associated with the display module may be modulated by an external control signal.

A principal advantage of the present invention is that the display module can be standardized, providing the benefits of mass production in its manufacture. Yet the ultimate display designed for a user can be varied and complex, both as to the changing light patterns used and as to the shape of the sign. Use of the modules is straight forward and readily applied, since no great expertise is required to interconnect them into a display system. This stands in contrast to a computer driven system, for example. Yet whether a display be complex or simple, its overall hardware cost remains largely proportional to the number of modules used. Because of the modularity of the present invention, the overall hardware cost of a display built with it remains largely proportional to the number of modules used.

DESCRIPTION OF PREFERRED EMBODIMENTS

Figure 1:
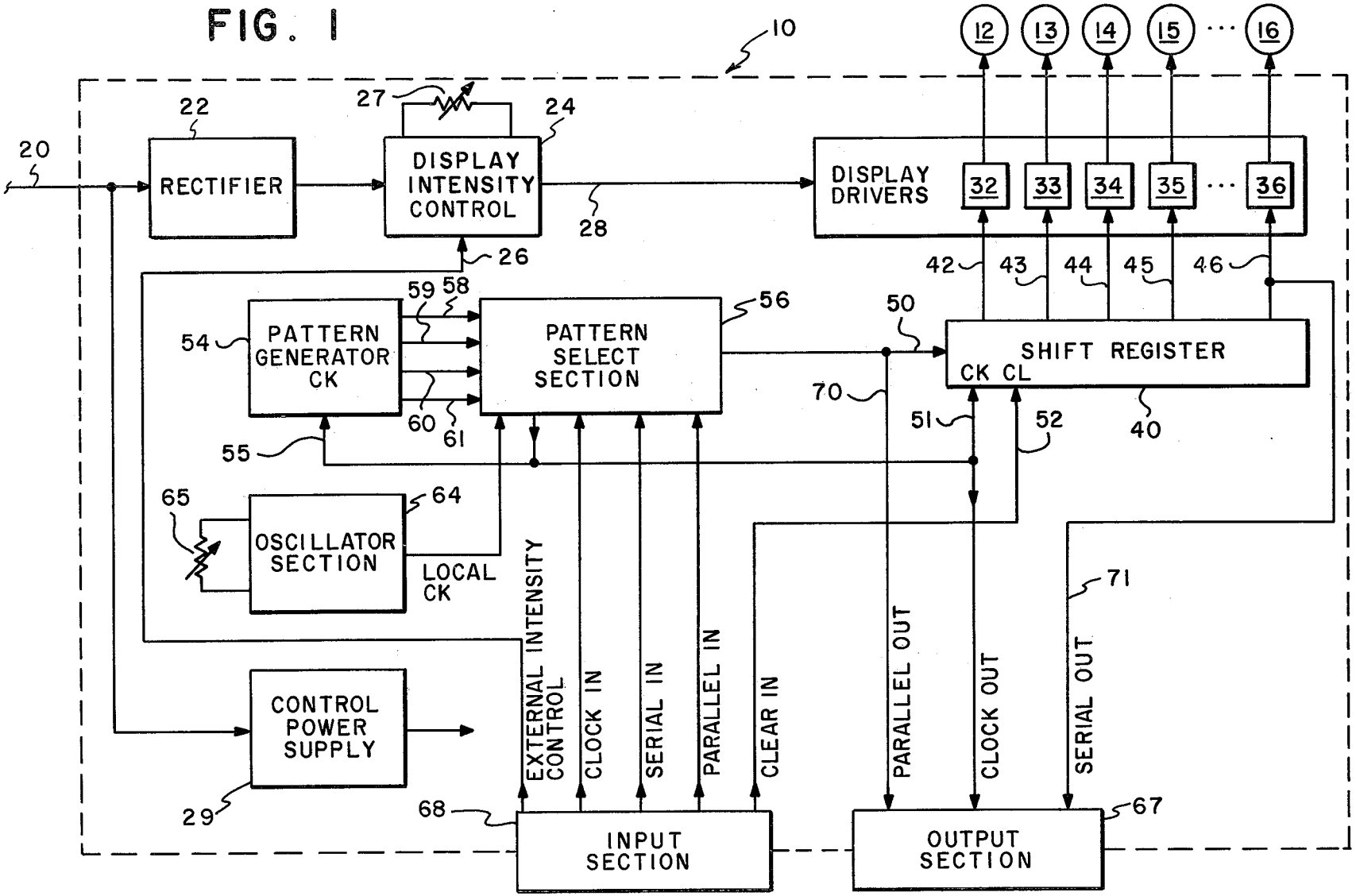
FIG. 1 is a block diagram of a display module according to the invention.

In FIG. 1, there is illustrated a display module according to the invention, enclosed in a broken line and indicated generally by the reference numeral 10. A set of lights or lamps 12–16 is controlled by module 10. The drawing is intended to indicate that the number of clamps in the set is selectable. In manufacturing the module 10, a judgment would be made as to the number of clamps which would constitute useful modular units in particular types of displays. For example, 32 lamps may be a useful number in a wide range of displays.

In the embodiment shown in FIG. 1, the set of lamps 12–16 forms a sequence, and a light pattern appears to move through the sequence. For example, the lights could form the pattern ON, ON, OFF, OFF, ON, ON, OFF, OFF . . . Initially, lights 12 and 13 would be on with lights 14 and 15 off. Then the lights would be switched to a state wherein lights 13 and 14 were lit, while lights 12 and 15 were off. Next, lights 14 and 15 would be on, with lights 12 and 13 off. This gives the appearance that the light pattern is moving to the right in the drawing, through the sequence of lamps.

Power for the lamps is derived from AC power line 20, full wave rectified by rectifier 22. Power for the control electronics is provided separately by control power supply 29. The output of rectifier 22 is input to display intensity control 24, which includes well-known thyristor dimmer circuitry. In response to a control voltage 26 or the setting of a manual control 27, intensity control 24 varies the phase angle during which the rectified power waveform is passed through to output 28. This allows the power level at output 28 to be set manually, or for example to be varied according to an arbitrary waveform, as is done in a light organ.

The power output 28 is applied to lamps 12–16 by display drivers 32–36. Each of the display drivers includes a power switching device such as an SCR in series with one of the lamps across the power output line 28. Each of the power switching gates is controlled by one of the outputs 42–46 of a shift register 40.

Shift register 40 is of conventional design, with an input 50 to the first stage of the register, a clock input 51 which causes the register to shift and a clear input 52 in order to clear the register and thereby, the lamps of the display. The outputs of each stage of register 40 are the outputs 42–46 to the display drivers. When, for example, the stage associated with output 43 is in the "1" state, the power switch of display driver 33 is gated on, turning on lamp 13. When the shift register stage associated with output 43 is in the "0" state, display driver 33 leaves lamp 13 off.

The pattern to be display in the lamps 12–16 is generated by pattern generator 54.

Alternatively, pattern generator 54 may comprise a read-only memory with a stored sequence of ones and zeroes which is repetitively read out. Several such sequences can be provided at multiple outputs of generator 54 to allow a choice of patterns for the user as is done with the counter generator.

One embodiment of pattern generator 54 is a 16 state counter, with each of the four bits represented by the counter being one of four outputs 58–61 of pattern generator 54. One of the outputs 58–61 corresponds to the $2^{\circ}$ bit, exhibiting a time varying sequence of alternating ones and zeroes. The output from the $2^1$ bit is an alternating time sequence of pairs of zeroes and ones. The $2^2$ bit output is four ones alternating with four zeroes, and the $2^3$ bit is alternating sequences of eight ones and eight zeroes.

Pattern select section 56 has a switch for selecting between various pattern sources, including the individual outputs of generator 54, and for applying the selected pattern to input 50 of shift register 40. Select section 56 also includes a switch for selecting between an external clock source and a local clock pulse generated by oscillator section 64. The selected clock pulse is distributed to pattern generator 54 at clock input 55 thereof, and to clock input 51 of the shift register 40. Accordingly, the bit outputs of generator 54 are synchronized with the system clock pulse and the shifting of register 40.

By way of example, suppose that the $2^1$ bit output of pattern generator is applied by pattern selection section 56 to input 50 of shift register 40. Then at input 50 there is is an alternating sequence of pairs of ones and zeroes. At a first clock pulse, a one will be shifted into the first stage of shift register 40 and appear at output 42 thereof. At the next, or second, clock pulse of clock input 51, another one is shifted into the first stage of register 40, while the first one appears at second stage output 43. Then on the third and fourth clock pulses at input 51, zeroes are shifted into register 40. The fifth and sixth clock pulses bring in another pair of ones from input 50. Because of the nature of the shift register 40, the pattern from input 50 progressively moves through register 40, appearing at the outputs thereof, including output 46 eventually. As the pattern of ones and zeroes shifts through shift register 40, it activates and deactivates the display drivers 32–36, as described above, so that a corresponding light pattern sequences through lamps 12–16.

In display module 10, the rate at which the light pattern sequences through lamps 12–16 can be controlled. Oscillator section 64 has a manual control 65 which permits selection of the clock pulse frequency, which in turn controls the rate at which generator 54 outputs ones and zeroes and the rate at which shift register 40 shifts. Preferrably, oscillator section 64 will cover a range of frequencies compatible with the human psychovisual response to switching lights.

An important aspect of the present invention is the interconnection of module 10 with other modules of the same kind. Output section 67 includes buffering stages for three outputs from module 10 to other modules. There is a parallel output 70 which is the same as input 50 to shift register 40. A clock output is the system clock applied to input 51 of shift register 40 and elsewhere. Serial output 71 is the same as the last output 46 of shift register 40.

Input section 68 allows the use by module 10 of an externally generated intensity control, clock, a serial input, a parallel input and a clear signal. It is preferable that these inputs be capable of connection to module 10 without connecting the local ground point of module 10 to an external ground. Accordingly, each of the input lines in section 68 includes an isolator, such as an optoelectric isolator.

The external intensity control is connected to input 26 of the display intensity control 24. As a result, an external intensity control voltage applied to input section 68 controls output 28 of the display intensity control and, thereby, the intensity of lamps 12–16 as a group.

The clear input is connected to clear input 52 of shift register 40. The external clock is connected from input section 68 to pattern select section 56, which includes a switch to select between the external clock and that generated by oscillator section 64. As previously described, section 56 supplies the selected clock pulse to input 55 of pattern generator 54 and input 51 of shift register 40.

Pattern select section 56 is also used to select between internally generated patterns and the external serial or parallel inputs. As may be understood from the nature of the parallel output 70 of module 10, an externally generated parallel input is a sequence of bits derived from the input to a shift register in another module. This parallel input can be applied by pattern select section 56 to input 50 of shift register 40. It should be apparent that the result of receiving such a parallel input from another module along with the clock pulse from that module, is to cause shift register 40 to respond in the same way at the same time as the shift register in the other module. Lamps 12–16 will be switched on and off at the same times as corresponding lamps controlled by the other module.

The serial input to module 10 from another module is, like serial output 71, the last output of the shift register of the other module. This shift register output can be connected by pattern select section 56 of module 10 to input 50 of shift register 40. The result is that the state of the last output in the shift register of the other module shifts to the first output 42 of shift register 40. The net effect is for the pattern moving through the sequence of lamps controlled by the other module to move through lamps 12–16, just as though lamps 12–16 were a continuation of the other lamp sequence.

For simplicity of use, module 10 is preferably provided with a multiconductor cable connecting from the three outputs of the output section of one module to the corresponding clock, serial and parallel inputs of another module. Then pattern select section 56 is used to select between the various external and internal patterns.

Figure 2:
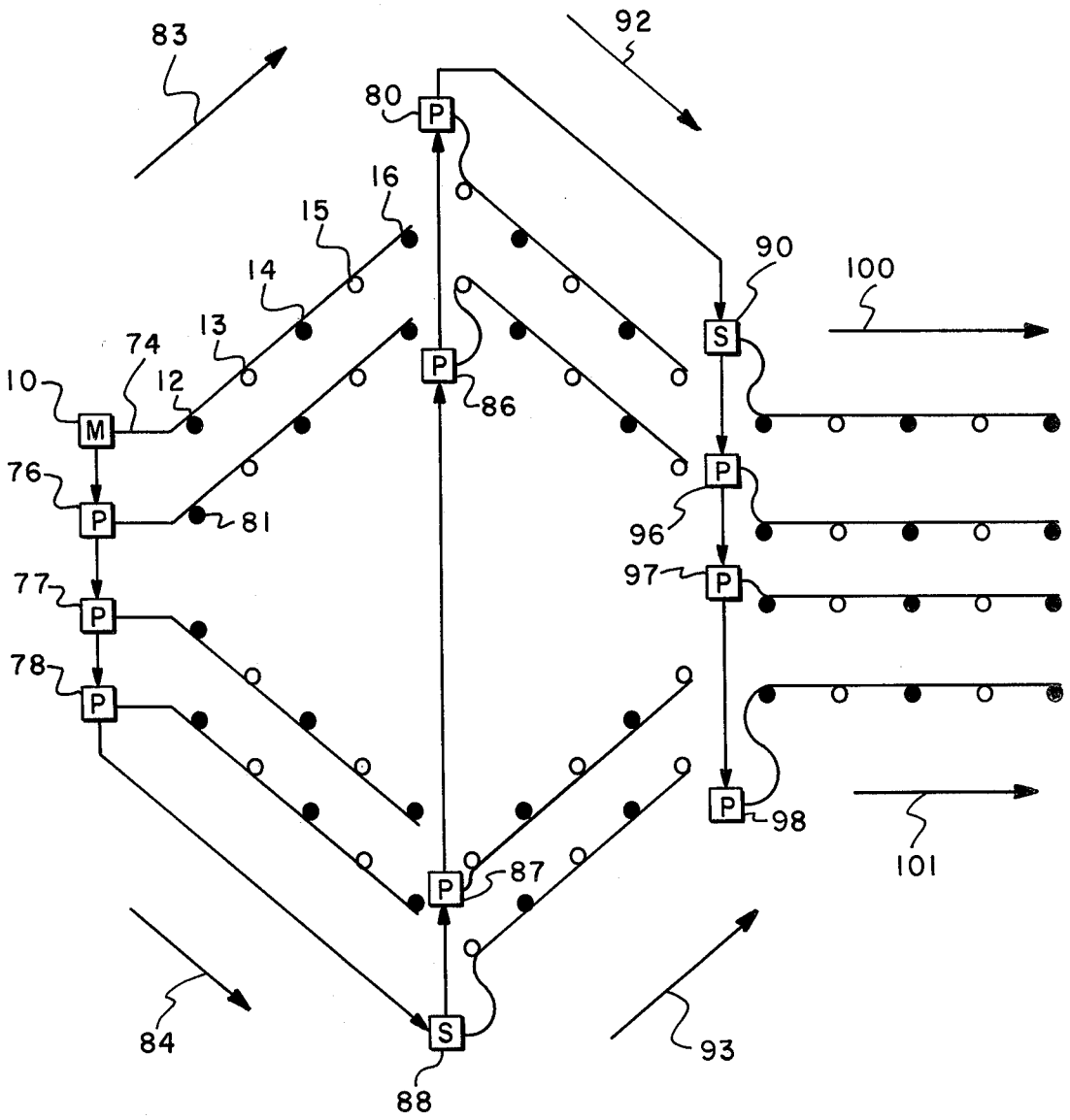
FIG. 2 is an interconnection diagram of a possible display using modules according to the invention.

FIG. 2 illustrates how modules according to the invention can be interconnected to form a display. Module 10 is marked with an "M" indicating that it is the master module, directly and indirectly controlling the other modules of the display. Lamps 12–16 and the other lamps of the display are shown in a geometric relationship to one another which forms the design of the display. Lamps 12–16 are shown connected to module 10 by a cable 74. Module 76, interconnected with module 10, is marked with a "P" to indicate that the parallel output from module 10 is switched into the shift register of module 76. Accordingly, lamp 81 and the other lamps shown to be controlled by module 76 change in brightness at the same time and in the same way as the corresponding members of the lamp sequence 12–16. Module 77 is connected to receive a control input from module 76 and is switched to operate in parallel with module 76. Since the parallel output from module 76 derives from module 10, module 77 operates in parallel with module 10, the same as module 76. Module 78 is connected in parallel with module 77, and as a result, operates in synchrony with module 10, also.

Module 88 receives its control input from module 78 and, as indicated with an "S", is switched to operate serially with respect to module 78. Thus, as a pattern moves through the string of lights associated with module 78, the pattern will appear to move on into the sequence of lamps controlled by module 88. As shown, modules 87, 86, and 80 are set up to operate in parallel with module 88.

Module 90 is connected to operate serially with respect to module 80, so that a pattern moving through the lamps controlled by module 80 seems to move on into the sequence controlled by module 90. Modules 96, 97, and 98 are interconnected and switched so as to operate in parallel with module 90.

The operation contemplated for the display shown in FIG. 2 begins with a pattern moving along the sequence of lamps 12–16 and those connected in parallel with it, as indicated generally by arrows 83 and 84. Then, the pattern appears to move on in to lamps controlled by modules 80, 86, 87, and 88 as indicated by the arrows 92 and 93. Finally, the pattern will appear to progress into the lamps controlled by modules 90–98, as indicated by arrows 100 and 101. To the observer, the pattern will appear to move from the lamps controlled by module 10 on to those controlled by module 80, then into those controlled by module 90. Patterns originating in modules 76, 77, and 78 behave similarly.

As can be appreciated from the example of FIG. 2, displays formed by interconnection of modules according to the invention can be made indefinitely large and complex, all according to the needs of the user. Of course, very simple displays are possible, such as a "chaser", which can be used, for example on a Christmas tree. A chaser can be made by connecting the serial output of a module to its own "CLEAR" input. To provide for this operation, pattern select section 56 is provided with a setting wherein the input to shift register 40 is always a "1".

The module of the invention also offers considerable control flexibility with respect to different light patterns, the speed with which the patterns move, and the intensity of the lights as a group. In the preferred embodiment described herein, each module can receive an external intensity control voltage, with the modules being controlled all from a single source or from a variety of sources.

Whereas the modules according to the invention can be interconnected to form a display without an elaborate central control, it is also possible to control one or more of the modules in a display from a computer. All of the inputs to input section 68 are susceptible to such control. The external display intensity control should, of course, be an analog voltage in accordance with the nature of display intensity control 26 described above.

As compared to prior art methods of driving light displays, the modular design of the present invention can be made to provide several advantages. As contrasted with the motor actuated switch type display, the modules of the present invention can be designed to fully exploit the reliability of solid state electronics. In physical design, the control circuitry shown in FIG. 1 can be made quite compact, providing for straightforward installation, and having an appearance that does not detract from that of the display as a whole.

The modulator nature of the present invention provides an inherent power dissipation advantage. For example, in a conventional design, if a light pattern is to move through a sequence of sixty lights, power busses capable of supplying this many lights would be included in the system. In the present invention, two sequences of thirty lights, each controlled by a module, could be used. The interconnection between the two 30-lamp sequences would be low power control cables, rather than the power connections of the prior art. Each lamp sequence and its associated hardware would dissipate its power in spatially distinct areas of the total display.

Thus, the present invention comprehends a totally different approach to the formation of light displays, an approach offering operational and cost advantages, as well as great flexibility and ease of application.

Although preferred embodiments of the invention have been described in detail, it is to be understood that various changes, substitutions and alterations can be made therein, without departing from the spirit and scope of the invention as defined by the appended claims.

I claim:

1. A display module for interconnection with modules of the same kind, each having a set of lights associated therewith, to form a display system, said module comprising:

means responsive to control signals for controlling the intensity of each of a plurality of lights in a set associated therewith;

means for generating said control signals capable of driving said controlling means so as to display a time-varying intensity pattern in the associated set of lights;

input means for deriving said control signals for said controlling means from an external source, including from another module of the same kind; and parallel output means for driving a like module so as to synchronously display the same pattern.

2. The display module of claim 1, wherein said set of lights form a first sequence of lights, and said pattern generated varies with time so as to move along the sequence of lights, and said display module further includes serial output means for driving a second module of the same kind to display said pattern in a second sequence of lights associated with the second module, in such a manner that the second sequence becomes a continuation of the first sequence.

3. A display module for interconnection with modules of the same kind, each having a sequence of lights associated therewith, to form a display system, said module comprising;

means for controlling the intensity of each of a plurality of lights in a first sequence associated therewith;

means for driving said controlling means so as to display a time varying intensity pattern moving along said first sequence of lights;

input means for driving said controlling means from an external source, including from another module of the same kind;

parallel output means for driving a like module so as to synchronously display the same pattern; and serial output means for driving a second module of the same kind to display said pattern in a second sequence of lights associated with the second module, in such a manner that the second sequence becomes a continuation of said first sequence.

4. The display module of claim 3, wherein said means for driving includes means for selecting from a plurality of patterns to be displayed in said first sequence of lights.

5. The display module of claim 3, further including means for selecting the speed of movement of said pattern along said first sequence of lights.

6. A display module for interconnection with modules of the same kind, each having a sequence of lights associated therewith, to form a display system, said module comprising:

means responsive to control signals for controlling the intensity of each of a plurality of lights in a first sequence associated therewith;

means for generating said control signals capable of driving said controlling means so as to display a time-varying intensity pattern moving at a selectable speed along the associated sequence of lights, including means for selecting the displayed pattern from a plurality of patterns;

input means for deriving said control signals for said controlling means from an external source, including from another mdoule of the same kind;

parallel output means for driving a like module so as to synchronously display the selected pattern;

serial output means for driving a second module of the same kind to display said pattern in a second sequence of lights associated with the second module in such a manner that the second sequence becomes a continuation of said first sequence; and means responsive to a modulating signal for controlling the intensity of all the lights in said first sequence in accordance with the modulating signal.

* * * * *